US010246834B1

(12) United States Patent
Ellwein et al.

(10) Patent No.: US 10,246,834 B1
(45) Date of Patent: Apr. 2, 2019

(54) TAMPER BAR AND WEAR PLATE FOR SCREED ASSEMBLY OF PAVING MACHINE

(71) Applicant: CATERPILLAR PAVING PRODUCTS INC., Brooklyn Park, MN (US)

(72) Inventors: Jacob Ryan Ellwein, Oak Grove, MN (US); John Eron Jorgensen, Andover, MN (US); Mauro Dal Cero, Budrio Balogna (IT)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 15/817,913

(22) Filed: Nov. 20, 2017

(51) Int. Cl.
*E01C 19/48* (2006.01)
*E01C 19/12* (2006.01)
*E01C 19/40* (2006.01)

(52) U.S. Cl.
CPC ..... *E01C 19/4833* (2013.01); *E01C 19/12* (2013.01); *E01C 19/40* (2013.01); *E01C 19/48* (2013.01)

(58) Field of Classification Search
CPC ..... E01C 19/48; E01C 19/4833; E01C 19/12; E01C 19/40
USPC ..... 404/79, 118
See application file for complete search history.

(56) References Cited

U.S. PATENT DOCUMENTS 8,764,342 B1 * 7/2014 Kopacz ..... E01C 19/30 37/381
2006/0034658 A1 * 2/2006 Heims ..... E01C 19/40 404/114
2010/0296868 A1 * 11/2010 Braun ..... B60K 6/40 404/118
2015/0037097 A1 * 2/2015 Caputo ..... E01C 19/4833 404/95
2016/0186389 A1 * 6/2016 Graham ..... E01C 19/48 404/79
2017/0138002 A1 * 5/2017 Caputo ..... C23C 4/126
2017/0268181 A1 * 9/2017 Laugwitz ..... E01C 19/30

FOREIGN PATENT DOCUMENTS

EP 1258564 11/2002

* cited by examiner

*Primary Examiner* — Raymond W Addie
(74) *Attorney, Agent, or Firm* — Finnegan, Henderson, Farabow, Garrett & Dunner, LLP

(57) ABSTRACT

A screed assembly for a paving machine, the screed assembly includes a screed frame, a screed plate attached to the screed frame, a wear plate attached to the screed frame, a tamper bar mounted to the screed frame and configured for up and down reciprocating motion relative to the screed frame, and an eccentric drive mechanism mounted on the screed frame and configured for driving the tamper bar up and down in a reciprocating manner relative to the screed frame. A bottom portion of the tamper bar is configured to slide along the wear plate, which is attached to the screed frame in between the screed frame and the reciprocating tamper bar. The tamper bar includes at least two intersecting chamfered surfaces with different angles from each other and relative to the screed plate at a leading edge of the tamper bar facing in a direction of travel of the paving machine as the paving machine is applying paving material to a surface.

12 Claims, 7 Drawing Sheets

TAMPER BAR AND WEAR PLATE FOR SCREED ASSEMBLY OF PAVING MACHINE

TECHNICAL FIELD

The present disclosure generally relates to paving machines and, more particularly, to a tamper bar and wear plate for screed assemblies of paving machines.

BACKGROUND

Paving machines are commonly used to apply, spread and compact a paving, i.e., a mat of asphalt or other paving material, relatively evenly over a work surface. These machines are generally used in the construction of roads, parking lots and other areas. An asphalt paving machine generally includes a hopper for receiving asphalt material from a truck or material transfer vehicle, and a conveyor system for transferring the asphalt rearwardly from the hopper for discharge onto a roadbed. A screed plate smooths and compacts the asphalt material, ideally leaving behind a roadbed of uniform depth and smoothness.

In order to help achieve the desired uniform depth and smoothness, as well as to accommodate different desired roadbed configurations, a screed assembly may include a variety of screed sections and adjustments. These adjustments can be used to vary, for example, the thickness of the mat as well as the degree of any crown and the cross slopes of the same. To improve the asphalt compaction and spreading capability of the various screed sections, screed assemblies often utilize a tamping mechanism. The tamping mechanism may pre-compact the asphalt before the paving material passes underneath the screed plate. The tamping mechanism may include a tamper bar and a wear plate on each screed section. The tamper bar may pre-compact and feed the asphalt under the screed plate for effective spreading and further compacting on the paving surface. The wear plate may be found behind the tamper bar and may be mounted to a screed frame such that a bottom surface of the wear plate is substantially aligned with a bottom surface of the screed plate. The wear plate may be configured and positioned to act as a sacrificial plate between the tamper bar and the screed frame and screed plate, preventing damage to the screed frame and screed plate as the tamper bar reciprocates upward and downward relative to the wear plate during a tamping operation.

The wear plate minimizes wear and tear to the screed plate and the screed frame to which the wear bar is mounted. The wear plate, which is a replaceable component, is generally mounted to the screed frame such that a bottom surface of the wear plate is above the bottom edge of the screed plate. In other words, the wear plate maintains a height tolerance relative to the bottom (asphalt finishing surface) plane of the screed plate. Such a height tolerance is often desired to prevent the wear plate from protruding or otherwise extending beyond the bottom edge of the screed plate (and therefore the screed section) and, thus, leaving a pattern or marking on the paving surface as the associated screed section compacts and spreads the asphalt. Existing tamper bars and wear plates may experience accelerated wear as a result of limitations on the amount of tamper bar material present at an interface between a surface of the tamper bar that experiences the most reactionary force from the asphalt during a tamping operation and the asphalt that is being tamped, and on the amount of material present at an interface between the tamper bar and the wear plate.

The disclosed systems and methods are directed at least in part to overcoming the above disadvantages.

SUMMARY OF THE DISCLOSURE

In one aspect of the disclosure, a screed assembly for a paving machine includes a screed frame, a screed plate attached to the screed frame, a wear plate attached to the screed frame, a tamper bar mounted to the screed frame and configured for up and down reciprocating motion relative to the screed frame, and an eccentric drive mechanism mounted on the screed frame and configured for driving the tamper bar up and down in a reciprocating manner relative to the screed frame. A bottom portion of the tamper bar is configured to slide along the wear plate, which is attached to the screed frame in between the screed frame and the reciprocating tamper bar, and the tamper bar includes at least two intersecting chamfered surfaces with different angles from each other and relative to the screed plate at a leading edge of the tamper bar facing in a direction of travel of the paving machine as the paving machine is applying paving material to a surface.

In another aspect of the disclosure, a paving machine includes an engine, a hopper for receiving asphalt material, a conveyor system for transporting the asphalt material rearward from the hopper for deposit onto a surface, and a screed assembly operatively associated with the engine and configured to smooth and compact the asphalt material into a mat. The screed assembly includes a screed frame, a screed plate attached to the screed frame, a wear plate attached to the screed frame, a tamper bar mounted to the screed frame and configured for up and down reciprocating motion relative to the screed frame, and an eccentric drive mechanism mounted on the screed frame and configured for driving the tamper bar up and down in a reciprocating manner relative to the screed frame. A bottom portion of the tamper bar is configured to slide along the wear plate, which is attached to the screed frame in between the screed frame and the reciprocating tamper bar, and the tamper bar includes at least two intersecting chamfered surfaces with different angles from each other and relative to the screed plate at a leading edge of the tamper bar facing in a direction of travel of the paving machine as the paving machine is applying paving material to a surface.

In yet another aspect of the disclosure, a tamper bar and wear plate assembly for a paving machine includes a tamper bar, and a wear plate attached to a screed frame of the paving machine by one or more recessed fasteners. The tamper bar is configured for sliding engagement with the wear plate along a substantially vertical interface surface of a bottom portion of the tamper bar. The tamper bar includes a bottom surface that extends in a direction substantially parallel to a direction of travel of the paving machine and substantially perpendicular to a direction of compaction of material being applied to a surface by the paving machine. The bottom surface of the tamper bar intersects with a first chamfered surface extending upward from the bottom surface at a first angle relative to the bottom surface toward a forward-facing leading edge of the tamper bar. The first chamfered surface intersects with a second chamfered surface extending upward from the first chamfered surface at a second angle relative to the bottom surface to intersect with the forward-facing leading edge of the tamper bar, and the second angle is greater than the first angle. A gap is formed between upper portions of the tamper bar and the wear plate above the vertical interface surface, and the gap is unobstructed by any portion of the one or more recessed fasteners attaching the wear plate to the screed frame.

Other features and aspects of the present disclosure will be apparent from the following description and the accompanying drawings.

DETAILED DESCRIPTION

Figure 1:
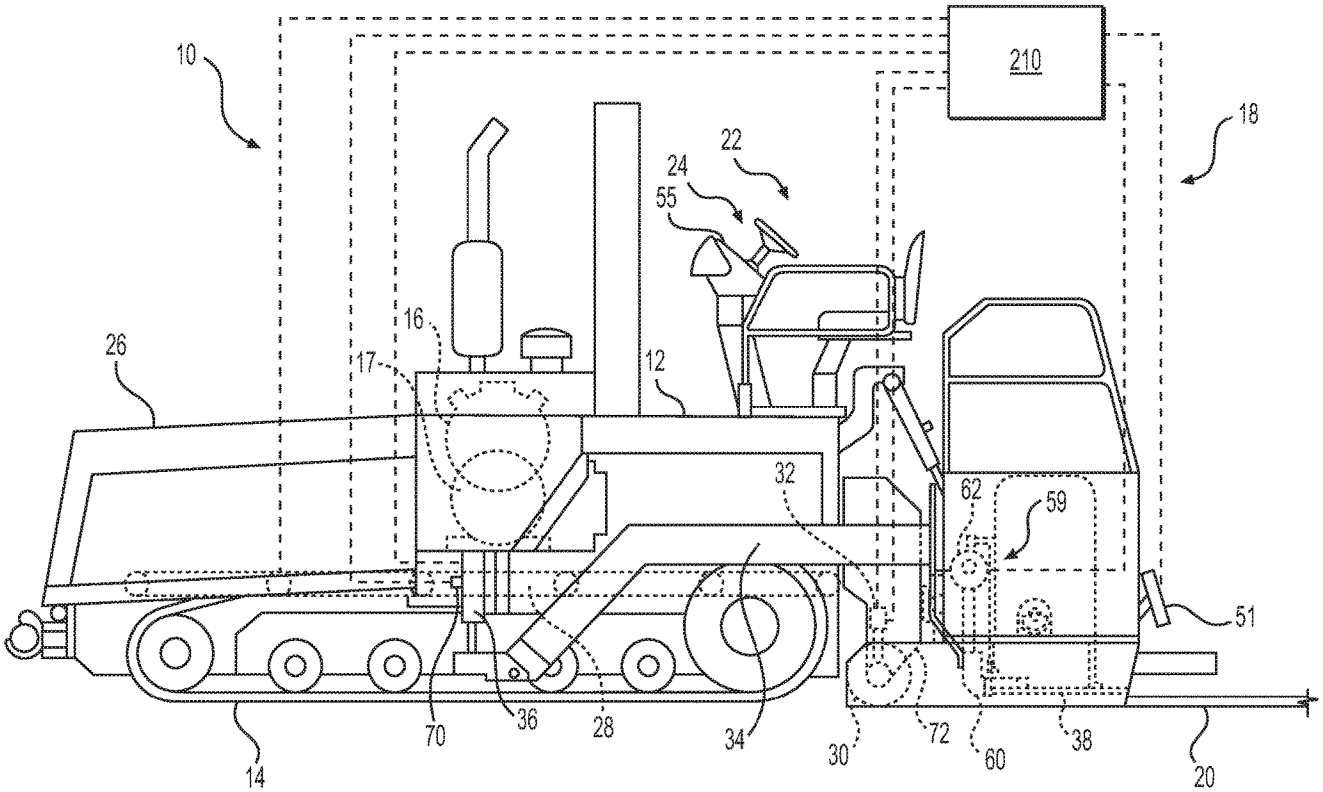
FIG. 1 is a side elevation view of a paving machine towing a screed assembly in accordance with the present disclosure.

Referring to FIG. 1, a paving machine 10 includes a frame 12 with a set of ground-engaging elements 14 such as wheels or tracks coupled with the frame 12. The ground-engaging elements 14 may be driven by an engine 16 in a conventional manner. The engine 16 may further drive an associated generator 17 that can be used to power various systems on the paving machine 10. A screed assembly 18 is operatively associated with engine 16, and is attached at the rear end of the paving machine 10 to spread and compact paving material into an asphalt mat 20 having a desired thickness, size, uniformity, crown profile and cross slope. The paving machine 10 also includes an operator station 22 having a seat and a console 24, which includes various controls for directing operations of the paving machine.

The paving machine 10 further includes a hopper 26 for storing a paving material, and a conveyor system including one or more conveyors 28 configured to move paving material from the hopper 26 to the screed assembly 18 at the rear of the paving machine 10. One or more augers 30 are arranged near the forward end of the screed assembly 18 to receive the paving material supplied by the conveyor 28 and spread the material evenly beneath the screed assembly 18. The height of the augers 30 is adjustable via one or more height adjustment actuators 32, for example, hydraulic cylinders. Reference to the "forward" end of the screed assembly 18 means the end of screed assembly 18 facing in the direction of travel of paving machine 10 as paving machine 10 is applying the paving material to a surface (to the left in FIG. 1). Similarly, reference to a "forward-facing" surface of a component of screed assembly 18 means a surface facing in the direction of travel of paving machine 10 while paving machine 10 is applying paving material to a surface, while reference to an "aft-facing" surface of a component means a surface facing away from the direction of travel of paving machine 10 while paving machine 10 is applying paving material to a surface (to the right in FIG. 1). The phrase "direction of travel" of paving machine 10, as used herein, refers to the direction of travel of paving machine 10 as paving machine 10 is actually applying paving material to a surface by feeding the paving material from hopper 26 to one or more augers 30, which spread the material evenly in front of screed assembly 18 such that the paving material passes underneath screed assembly 18 as paving machine 10 moves forward in the direction of travel.

The screed assembly 18 is pivotally connected behind the paving machine 10 by a pair of tow arms 34 (only one of which is shown in FIG. 1) that extend between the frame 12 of the paving machine and the screed assembly 18. The tow arms 34 are pivotally connected to the frame 12 such that the relative position and orientation of the screed assembly 18 relative to the screed frame and to the surface being paved may be adjusted by pivoting the tow arms 34, for example, in order to control the thickness of the paving material deposited by the paving machine 10. To this end, tow arm actuators 36 are provided that are arranged and configured to raise and lower the tow arms 34 and thereby raise and lower the screed assembly 18. The tow arm actuators 36 may be any suitable actuators, for example, hydraulic cylinders.

Figure 2:
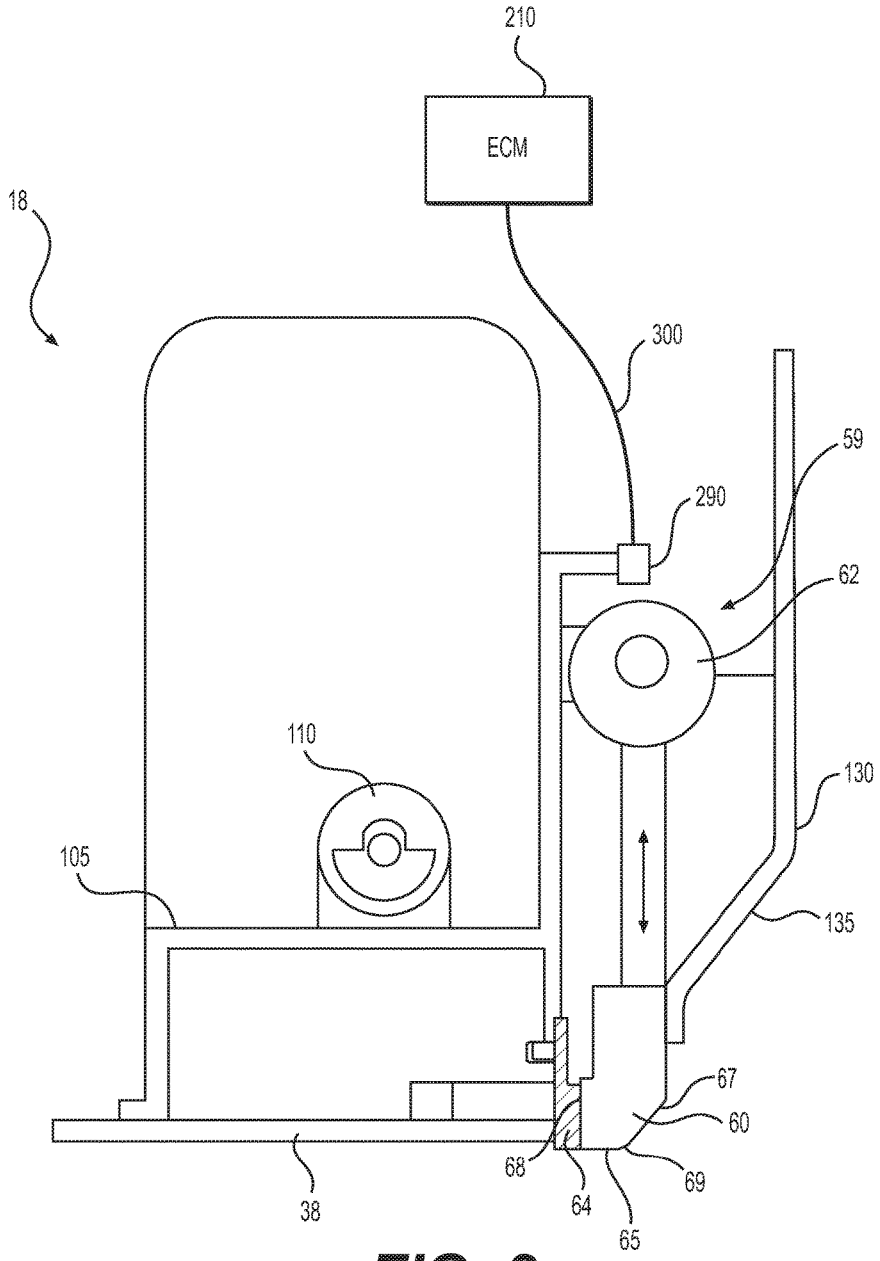
FIG. 2 is a side elevation view of the screed assembly of FIG. 1.

The screed assembly 18 may have any of a number of configurations known in the art, in particular, it may be a multiple section screed that has an adjustable crown profile and may include extensions with additional screed plates extending in a lateral direction to accommodate wider pavement areas. As shown in FIG. 2, the screed assembly 18 is provided with a screed plate 38. The screed plate 38 is configured to float on the paving material of asphalt mat 20 laid upon a prepared paving bed and to "smooth" or level and compact the paving material on the base surface, such as for example a roadway or roadbed. Screed plate 38 is connected, preferably by means of a carrier 105, to a vibrating shaft 110 coupled to a vibratory, eccentric drive. Vibrating shaft 110 generally includes weights placed eccentrically so that when a vibratory drive rotates the vibrating shaft 110, the shaft 110 causes carrier 105 and screed plate 38 to vibrate. Vibrating screed plate 38 to some degree improves compaction and quality of the asphalt mat 20 being laid on a prepared paving bed.

As shown in FIGS. 1 and 2, the screed assembly 18 may include a tamper bar assembly 59 positioned forward of the screed plate 38 and extending transversely to the direction of travel of the paving machine 10. The tamper bar assembly 59 may include a tamper bar 60 and a wear plate 64. Tamper bar 60 may be mounted to a screed frame of screed assembly 18 and configured to be reciprocated in an upward and downward direction substantially perpendicular to asphalt mat 20 and substantially perpendicular to the direction of travel of paving machine 10 by a tamper bar eccentric drive mechanism 62 and connecting members 61 (shown in FIG. 3). Tamper bar 60 extends generally transverse to the paving direction over substantially the entire width of the screed plate 38. Tamper bar 60 may be driven by eccentric drive mechanism 62 and may be configured to be adjustably displaceable by an amount of an adjustable stroke of the eccentric drive mechanism 62. A speed sensor 290 may be located adjacent the eccentric drive mechanism 62 and configured to produce a speed signal on an electrical connector 300 providing input to an electronic control module (ECM) 210. Tamper bar 60 contacts a forward-facing, substantially vertical surface 68 of wear plate 64, and slides along surface 68 of wear plate 64 while reciprocating in an upward and downward direction. Wear plate 64 is positioned between tamper bar 60 and screed plate 38, and between tamper bar 60 and the screed frame of screed assembly 18. Wear plate 64 acts as a sacrificial plate between tamper bar 60 and the screed frame of screed assembly 18 and between tamper bar 60 and screed plate 38 to prevent wear of the screed frame and screed plate by the reciprocating, upward and downward movement of tamper bar 60. Wear plate 64 may be easily removed from the screed frame and replaced as it is worn out from the tamping operations.

Figure 3:
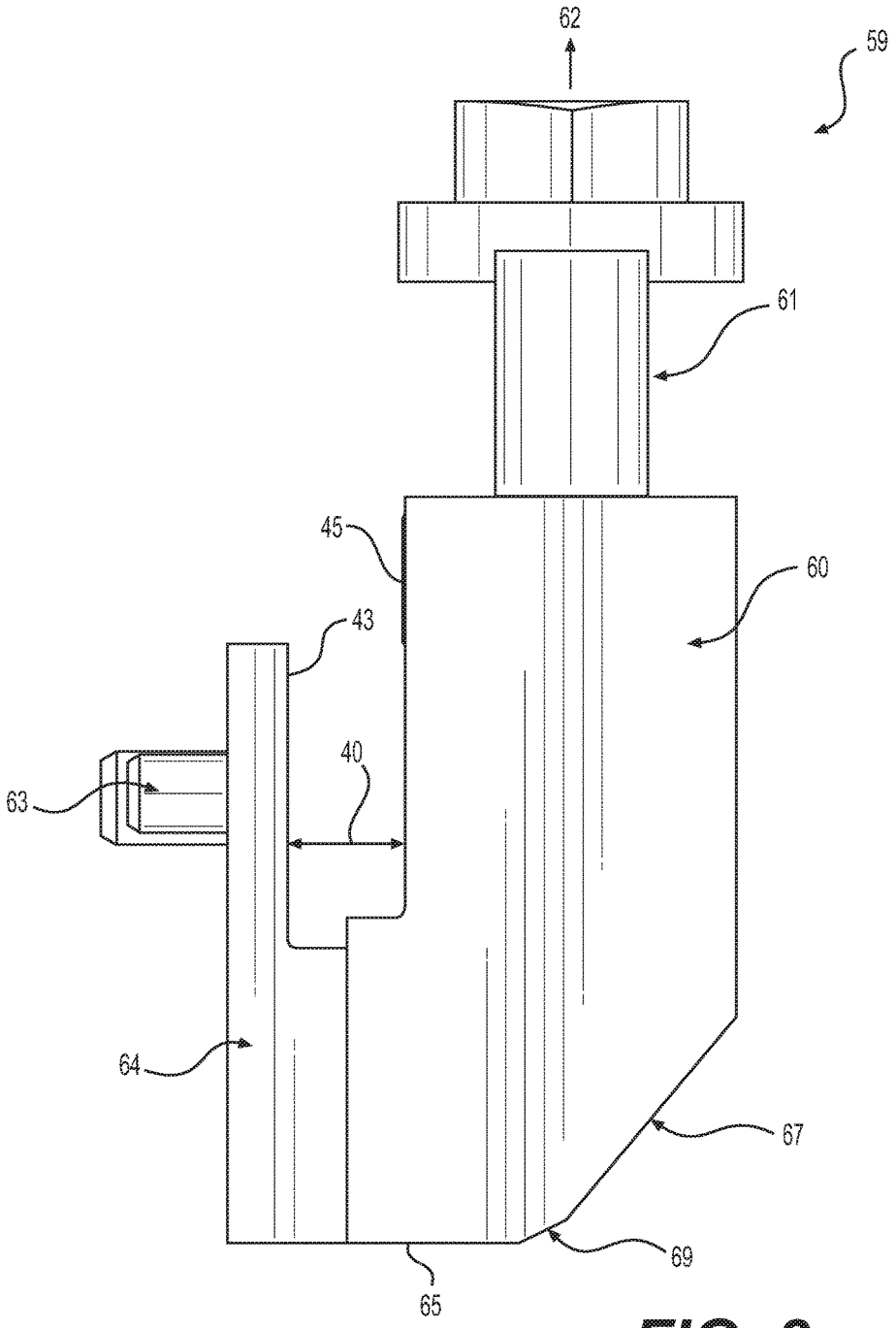
FIG. 3 is a side elevation view of a tamper bar and wear plate of the screed assembly of FIGS. 1 and 2.
Figure 4:
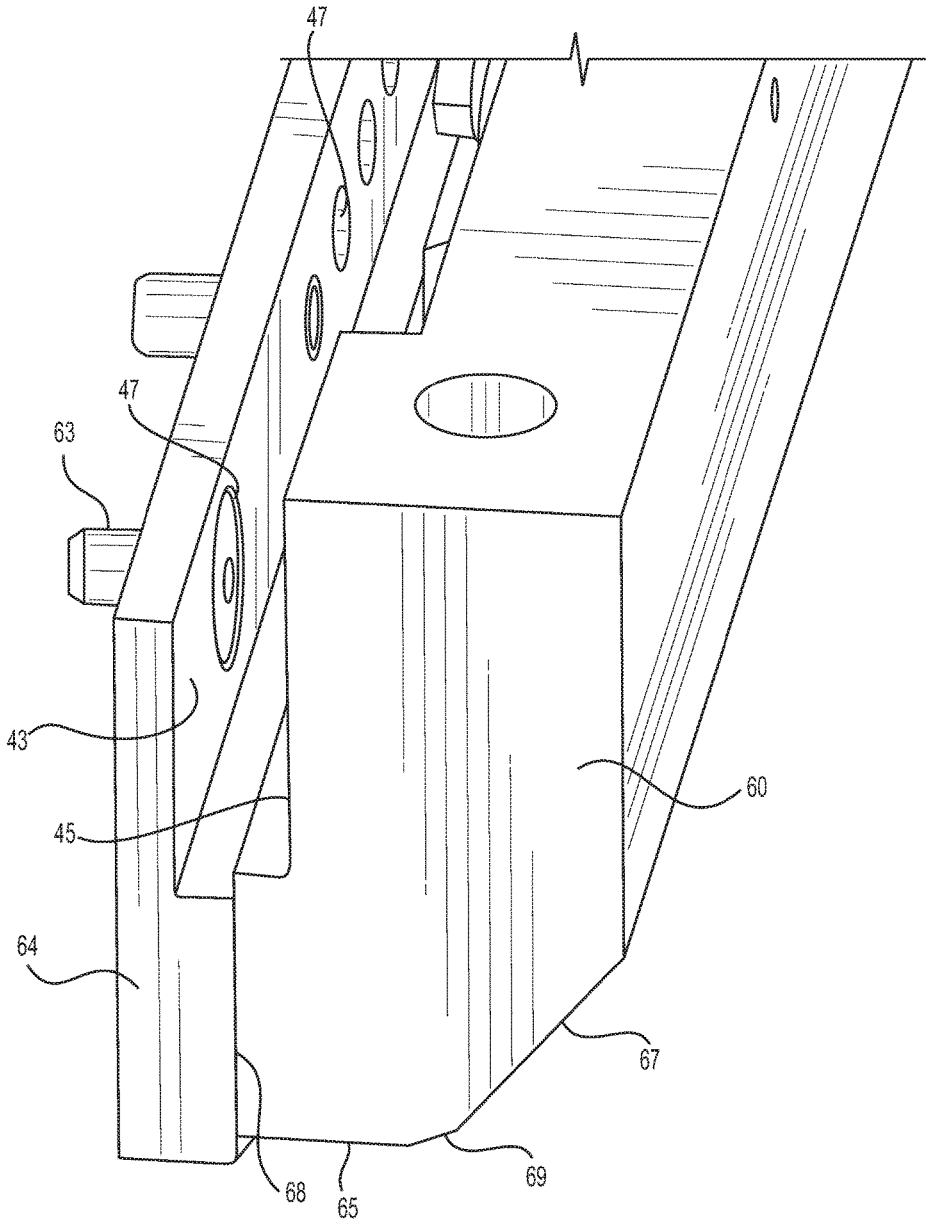
FIG. 4 is a perspective view of the tamper bar and wear plate of FIG. 3.
Figure 5:
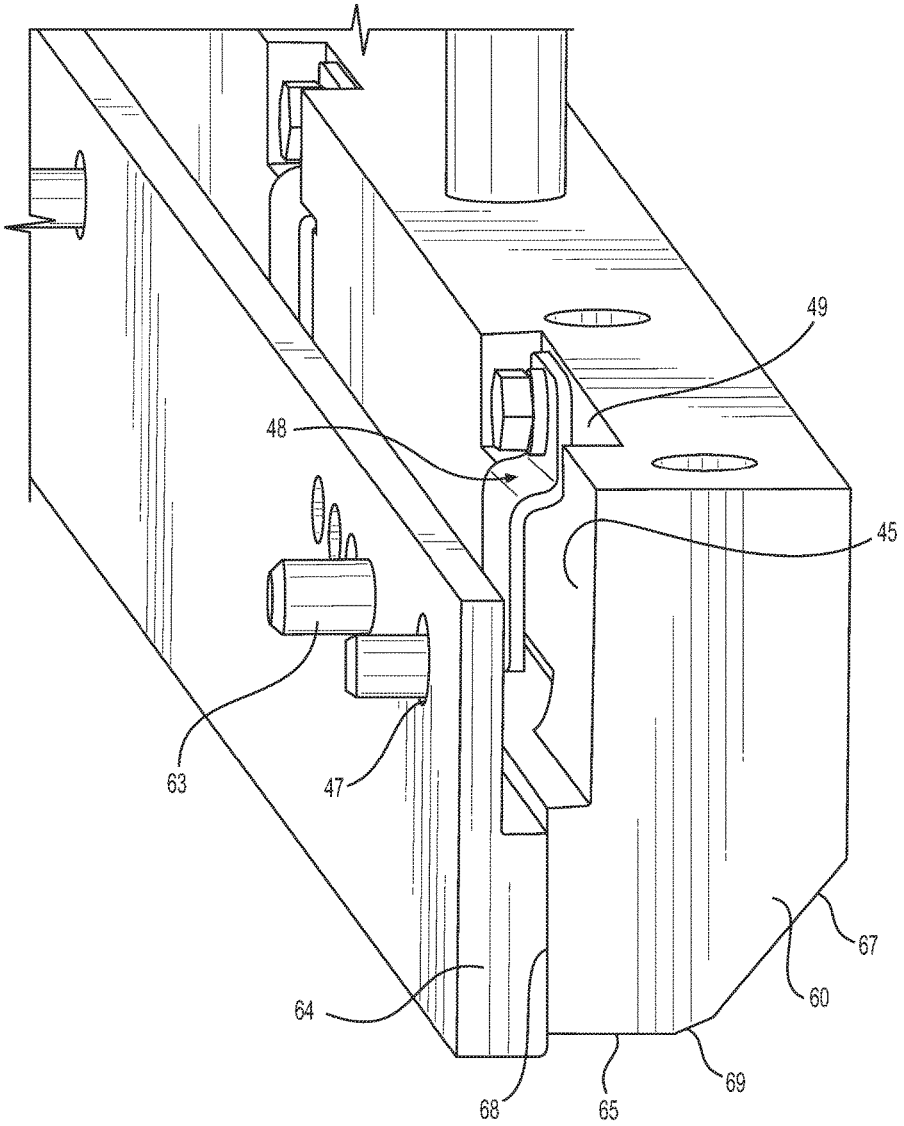
FIG. 5 is another perspective view of the tamper bar and wear plate of FIG. 3.

FIGS. 3-5 show tamper bar assembly 59 in more detail. Tamper bar 60 according to various embodiments of this disclosure is provided with a modified geometry in comparison to existing tamper bars such that the tamper bar according to this disclosure experiences less wear during operation and an extended work life. In particular, tamper bar 60 according to various embodiments of this disclosure includes a bottom surface 65 that is substantially parallel to screed plate 38 and substantially parallel to a top surface of asphalt mat 20, and that extends by a length in a direction substantially parallel to the direction of travel of paving machine 10 while paving machine 10 is applying paving material to a surface that is approximately 18 mm. The larger the above-described surface 65 is the larger the vertical reactionary forces are when tamper bar 60 contacts asphalt material during a tamping operation. The bottom surface 65 of tamper bar 60 is substantially perpendicular to the direction of compaction of the asphalt, and parallel to the top surface of the asphalt mat 20, and is therefore the surface of tamper bar 60 that is acted on by the greatest reactionary force from the asphalt materials during the tamping operation.

The increase in the length of bottom surface 65 of tamper bar 60 results in a larger total surface area of tamper bar 60 that is exposed to the largest reactionary force from the asphalt during a tamping operation. As a result, the modified tamper bar according to various embodiments of this disclosure will exert a larger compaction force on the asphalt pavement with each cycle of eccentric drive mechanism 62. The unexpected benefit achieved as a result of this change in the geometry of tamper bar 60 is that the speed of rotation of eccentric drive mechanism 62, and the resulting speed of tamper bar 60 and number of tamps per foot traveled by paving machine 10 can be reduced, thereby reducing wear and tear on the drive mechanism, tamper bar 60, and wear plate 64, and prolonging the life of screed assembly 18. The speed of rotation of eccentric drive mechanism 62 and number of tamps per foot traveled can be reduced since each tamp by the modified tamper bar according to this disclosure increases the vertical reactionary forces acting on the screed.

As best seen in FIGS. 3-5, bottom surface 65 of tamper bar 60 transitions in a forward-facing direction to a first chamfer 69 having a relatively shallow first angle relative to bottom surface 65 across the entire width of tamper bar 60. The first chamfer 69 then transitions into a steeper second chamfer 67 with a second angle relative to bottom surface 65 that is greater than the first angle of first chamfer 69. Second chamfer 67 also extends across the entire width of tamper bar 60, and forms a lead-in slope of tamper bar 60 extending downward and rearward from a front edge of tamper bar 60 to ensure optimum feed of paving material underneath bottom surface 65 of tamper bar 60 and underneath screed plate 38 as screed assembly 18 and tamper bar 60 move forward in the direction of travel of paving machine 10 during a paving operation.

Wear plate 64 is an L-shaped plate extending along the aft-facing side of a bottom portion of tamper bar 60. The substantially vertical interface surface 68 of wear plate 64 forms a wear surface against which tamper bar 60 slides as tamper bar 60 is reciprocated upward and downward by eccentric drive mechanism 62. Another improvement of the modified geometry tamper bar 60 according to various embodiments of this disclosure is a longer interface surface 68 than existing wear plates, thereby providing a greater wear surface area on both of tamper bar 60 and wear plate 64 and a resulting longer wear life. As shown in FIG. 3, an aft-facing surface 45 of tamper bar 60 is spaced to form a gap with a distance 40 between a forward-facing surface 43 of wear plate 64 and aft-facing surface 45 of tamper bar 60. Fasteners 63 extend through countersunk holes 47 in wear plate 64 to join wear plate 64 to the screed frame. Each of fasteners 63 is recessed into wear plate 64 such that no portion of each fastener 63 protrudes beyond the forward-facing surface 43 when fasteners 63 are tightened through countersunk holes 47 of wear plate 64 and into the screed frame. The countersunk aspect of fasteners 63 and the holes 47 through wear plate 64 in which they are received ensures that the entire distance 40 of the gap between aft-facing surface 45 of tamper bar 60 and forward-facing surface 43 of wear plate 64 is free from any protruding fasteners or other potential obstructions, thereby leaving a greater amount of available wear material on both wear plate 64 and tamper bar 60, and ensuring that fasteners 63 do not interfere with movement of tamper bar 60 as interface surface 68 wears away during tamping operations.

Screed assembly 18 includes a front wall 130 disposed proximal to auger 30 (shown in FIGS. 1 and 2), the auger 30 functioning to spread paving material falling off the end of conveyor 28 mounted on paving machine 10. The front wall 130 includes a lower guide portion 135, which is preferably inclined relative to tamper bar 60, and which terminates adjacent to tamper bar 60, such that lower guide portion 135 directs paving material from the auger 30 to the tamper bar 60. The angle of inclination of the guide portion 135 may correspond approximately to the angle of the lead-in slope of second chamfer 67 of the tamper bar 60.

Figure 6:
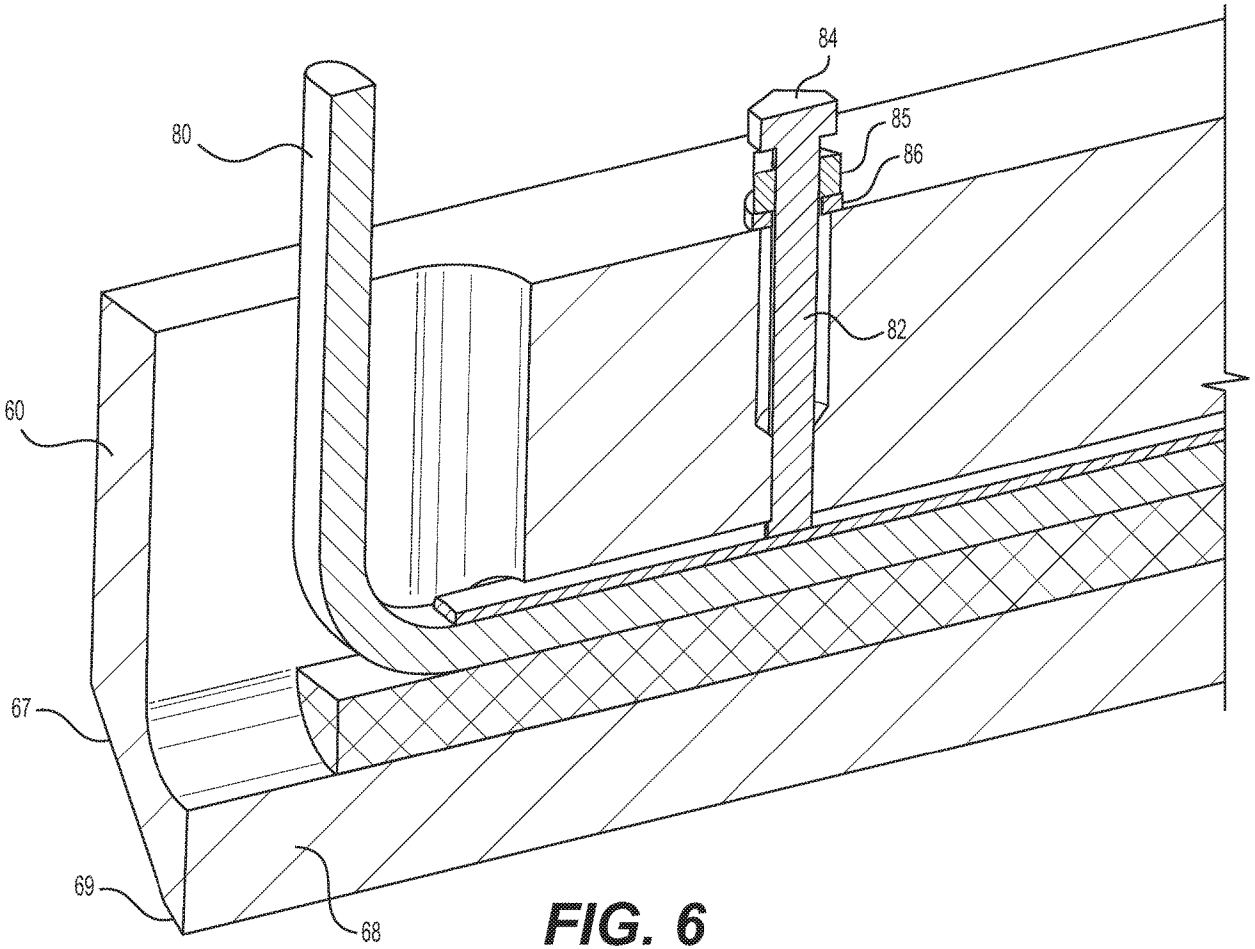
FIG. 6 is a cut-away perspective view of an embodiment of the tamper bar of FIG. 3, showing an embedded heating element.
Figure 7:
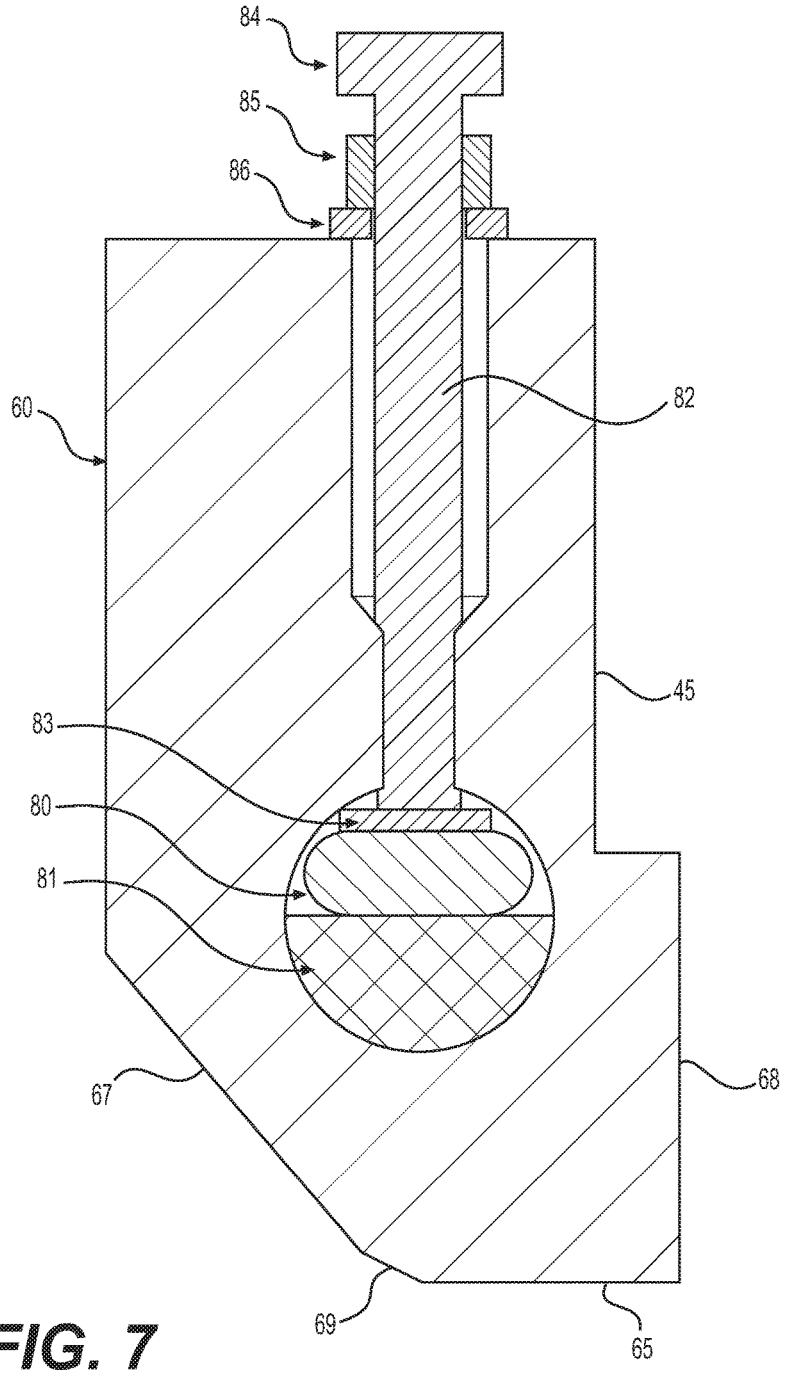
FIG. 7 is a cross-sectional, side elevation view of the tamper bar shown in FIG. 6.

Another benefit of the increased surface length of bottom surface 65 of tamper bar 60 is that additional material is provided on tamper bar 60 to allow for the insertion of one or more heating elements, such as a flat-surface geometry heating element 80. The heating element 80 allows tamper bar 60 to be maintained at a sufficiently high temperature so that it will not stick to the hot asphalt material being applied in mat 20 as tamper bar 60 repeatedly tamps the hot asphalt to form a uniformly compacted and level surface on mat 20. As shown in FIGS. 5-7, heating element 80 may extend along a width of tamper bar 60, transverse to the direction of travel of paving machine 10, and may be positioned in an opening through tamper bar 60, or in a recess 49 formed in aft-facing surface 45 of tamper bar 60. Heating element 80 may be held in place along the width of tamper bar 60 by clamps 48 attached to tamper bar 60 in spaced recesses 49 formed along the aft-facing surface 45. As shown in FIG. 7, heating element 80 may also be clamped vertically between a clamping plate 83 and an elongated, half-round insert 81 positioned below heating element 80 by one or more hold-down bolts 84, nuts 85, and washers 86. The added thickness to tamper bar 60 allows for heating element 80 and multiple hold down bolts 84 to be contained within tamper bar 60 so as to not interfere with the upward and downward reciprocating motion of tamper bar 60 during a tamping operation. The half-round insert 81 positioned below heating element 80 may be made from a thermally conductive material to enhance the thermal conductive path between flat-surface geometry heating element 80 and tamper bar 60, with body 82 of hold-down bolts 84 being tightened down onto clamping plate 83, heating element 80, and half-round insert 81 to eliminate any air gaps therebetween and enhance a thermal conductive path from heating element 80 to tamper bar 60.

As shown in FIGS. 1 and 2, an electronic control module ("ECM") 210 may be operatively connected with the various system components shown. A tamper bar mode selector may be connected through a wired electronic connector or bus 300 to ECM 210, or alternatively, may be connected wirelessly with ECM 210. The tamper bar mode selector may be a three position toggle switch, or other user input device. Those skilled in the art will recognize that other devices, including rotary switches, depressible button switches and the like could readily and easily be substituted for the three position switch. The mode selector may include three positions corresponding to an off mode, a manual mode and an automatic mode. The operator of asphalt paving machine 10 may place the mode selector in a position corresponding to a desired mode. In an alternative implementation, the mode selector may be operated remotely. In any case, the mode selector is configured to produce a mode signal on electrical connector 300 indicative of the selected mode.

A tamper bar desired speed input provided to ECM 210 may be a desired speed input, or a desired number of tamps per unit distance when the system is in the automatic mode. Markings may be provided on a dial in one exemplary embodiment, indicating to an operator a general desired tamping bar rotational velocity (when in manual mode) or a desired number of tamps per foot (when in automatic mode). The operator of the asphalt paving machine may move the dial to a position corresponding to the desired rotational speed of eccentric drive mechanism 62 or a desired number of tamps per foot, and the dial generates a signal on connector 300 indicative of the desired tamper bar speed or tamps per foot.

A tamper bar speed sensor 290 is associated with the eccentric drive mechanism 62 and produces a tamping bar speed signal on connector 300 indicative of the rotational velocity of the eccentric drive mechanism 62. Preferably, the tamping bar speed sensor is a passive sensor, such as a magneto restrictive type sensor. However, other types of speed sensors can be used without deviating from the scope of the present disclosure.

The ECM 210 produces a tamper bar control signal to control the rotational speed of the eccentric drive mechanism 62. In one exemplary embodiment, a tamper bar control signal may be received by a solenoid connected with a hydraulic pump associated with a hydraulic motor. The tamper bar control signal may control the flow of hydraulic fluid through conduits and thereby control the rotational speed of the hydraulic motor and eccentric drive mechanism 62 of tamper bar 60. Other power sources could be substituted for a hydraulic motor without deviating from the scope of the present disclosure. For example, in some applications it might be preferable to replace the hydraulic motor with an electric motor and controllably power the motor with electric power through associated power circuitry.

An asphalt paving machine speed sensor may also be connected with ECM 210 to produce a signal indicative of the speed that paving machine 10 is travelling. The speed sensor may be associated with a driveline on paving machine 10, which connects the engine to the tracks, or other ground engaging device. The speed sensor produces a signal indicative of the speed of the track, or other ground engaging device, which can be readily converted by ECM 210 to ground speed. Any of a variety of well known speed sensors could be used in connection with the present disclosure.

To coordinate and control various systems and components associated with the paving machine 10, including the screed assembly 18, an electronic or computerized control unit, module or controller 210 is provided. The controller 210 is adapted to monitor various operating parameters and to regulate various variables and functions affecting the operation of the paving machine. The controller 210 can include a microprocessor, an application specific integrated circuit (ASIC) or other appropriate circuitry and can have a memory or other data storage capabilities. The controller can include functions, steps, routines, data tables, data maps, charts and the like saved in and executed from the memory to control the paving machine. Although in the figures the controller 210 is illustrated as a single, discrete unit, in other embodiments, the controller and its functions may be distributed among a plurality of distinct and separate components. To receive operating parameters and send control demands and instructions, the controller 210 is operatively associated and can communicate with various sensors and controllers on the paving machine 10, as described in more detail below. Communication between the controller 210 and the sensors can be established by sending and receiving digital or analog signals across electronic communication lines or communication busses, including wireless communications. In FIG. 1, the various communication and command channels are indicated in dashed lines for illustration purposes.

In order to allow operators of the paving machine to enter and receive information concerning the operation of the paving machine, one or more user interfaces may be provided that are in communication with the controller 210. For the convenience of operators, the user interfaces may be located at various different locations on the paving machine 10. For example, a user interface 55 may be provided at the operator station 22 so as to be accessible to an operator sitting in the operator station, and one or more additional user interfaces 51 may be arranged at a lower position than or adjacent to the screed assembly 18 so as to be accessible to operators standing on the ground or rear walkway. Each user interface may include one or more input devices for changing settings of the paving machine 10, and one or more display devices for displaying the configuration of one or more components of the paving machine 10, for example, the configuration of the screed assembly 18. The input device may be any type of input apparatus, and the display device may also be any type of known display devices. In some embodiments, the input devices and display devices may be combined into a single device, for example, a touchscreen or the like.

To monitor and control the various different possible adjustments to the configuration of the screed assembly 18, the controller 210 communicates with various sensors. In particular, the controller 210 communicates with one or more tow arm position sensors 70 that monitor the position of the tow arms 34, as well as one or more auger position sensors 72 that monitor the vertical position of the augers 30 (see FIG. 1). Additionally, the controller 210 may communicate with one or more screed width sensors that monitor the distance at which any screed extensions are extended in the lateral direction. The controller 210 may also communicate with a crown profile sensor that monitors the relative orientation of left and right screed sections with respect to a centerline, and a cross slope sensor that measures the cross slope of the screed assembly 18. In addition to receiving information from the sensors, the controller 210 also communicates with and is configured to control the corresponding actuators, including the tow arm actuators 36, the auger height actuators 32, screed width actuators, and crown actuators.

In connection with the automatic control described above, sometimes slip of the tracks or wheels of the paving machine may result in errors with respect to the estimated distance travelled by the paving machine 10. In order to compensate such errors, a travel distance correction device may be configured to correct the travel distances measured by a travel distance measurement device, for example, based on acquired laser measurement data, acquired GPS data and acquired RTK data. Devices for acquiring such information that can be used in order to correct the measured travel distance are well-known and will not be described in detail herein.

INDUSTRIAL APPLICABILITY

The industrial applicability of the disclosed modified tamper bar and wear plate assembly for a screed assembly on a paving machine will be readily appreciated from the foregoing discussion. The modified geometry of the disclosed tamper bar ensures that the tamper bar according to this disclosure experiences less wear during operation and an extended work life. In particular, tamper bar 60 according to various embodiments of this disclosure includes bottom surface 65 that is substantially parallel to screed plate 38 and substantially parallel to a top surface of asphalt mat 20, and that extends by a length in a direction substantially parallel to the direction of travel of paving machine 10. The length of the bottom surface translates into a greater surface area of the portion of tamper bar 60 that is primarily responsible for compaction of paving material as it passes underneath screed plate 38. In one preferred embodiment, the length of bottom surface 65 of tamper bar 60 in a direction substantially parallel to a direction of travel of paving machine 10 is approximately 18 mm versus the 14 mm length of the bottom surface on existing tamper bars, or an increase of approximately 28%. The bottom surface 65 of tamper bar 60 is substantially perpendicular to the direction of compaction of the asphalt, and parallel to the top surface of the asphalt mat 20, and is therefore the surface of tamper bar 60 that is acted on by the greatest reactionary force from the asphalt materials during the tamping operation.

The increase in the length of bottom surface 65 of tamper bar 60 results in a larger total surface area of tamper bar 60 that is exposed to the largest reactionary force from the asphalt during a tamping operation. As a result, the modified tamper bar according to various embodiments of this disclosure will exert a larger compaction force on the asphalt pavement with each cycle of eccentric drive mechanism 62. The unexpected benefit achieved as a result of this change in the geometry of tamper bar 60 is that the speed of rotation of eccentric drive mechanism 62, and the resulting speed of tamper bar 60 and number of tamps per foot traveled by paving machine 10 can be reduced, thereby reducing wear and tear on the drive mechanism and prolonging the life of screed assembly 18. The speed of rotation of eccentric drive mechanism 62 and number of tamps per foot traveled can be reduced since each tamp by the modified tamper bar according to this disclosure compacts more material than possible with existing tamper bars.

Bottom surface 65 of tamper bar 60 transitions in a forward-facing direction to a first chamfer 69 having a relatively shallow first angle relative to bottom surface 65 across the entire width of tamper bar 60. An advantage achieved by providing a more gradual transition from bottom surface 65 of tamper bar 60 to a forward-facing edge of tamper bar 60 is the elimination of sharp corners at the transition when no chamfer or only one chamfer is provided in the transition from the bottom surface to the leading edge. The elimination of sharp corners reduces the chances of stress concentrations, or the formation of undesirable metallurgical grain structure formed during heat treatment of the tamper bar. The first chamfer 69 transitions into a steeper second chamfer 67 with a second angle relative to bottom surface 65 that is greater than the first angle of first chamfer 69. Second chamfer 67 also extends across the entire width of tamper bar 60, and forms a lead-in slope of tamper bar 60 extending downward and rearward from a front edge of tamper bar 60 to ensure optimum feed of paving material underneath bottom surface 65 of tamper bar 60 and underneath screed plate 38.

Wear plate 64 is an L-shaped plate extending along the aft-facing side of a bottom portion of tamper bar 60. The substantially vertical interface surface 68 of wear plate 64 forms a wear surface against which tamper bar 60 slides as tamper bar 60 is reciprocated upward and downward by eccentric drive mechanism 62. Another improvement of the modified geometry tamper bar 60 according to various embodiments of this disclosure is a longer interface surface 68 than existing wear plates, thereby providing a greater wear surface area on both of tamper bar 60 and wear plate 64 and a resulting longer wear life. As shown in FIG. 3, an aft-facing surface 45 of tamper bar 60 is spaced to form a gap with a distance 40 between a forward-facing surface 43 of wear plate 64 and aft-facing surface 45 of tamper bar 60. Fasteners 63 extend through countersunk holes 47 in wear plate 64 to join wear plate 64 to the screed frame. Each of fasteners 63 is recessed into wear plate 64 such that no portion of each fastener 63 protrudes beyond the forward-facing surface 43 of wear plate 64 when fasteners 63 are tightened through countersunk holes 47 of wear plate 64 and into the screed frame. The countersunk aspect of fasteners 63 and the holes 47 through wear plate 64 in which they are received ensures that the entire distance 40 of the gap between aft-facing surface 45 of tamper bar 60 and forward-facing surface 43 of wear plate 64 is free from any protruding fasteners or other potential obstructions, thereby leaving a greater amount of available wear material on both wear plate 64 and tamper bar 60, and ensuring that fasteners 63 do not interfere with movement of tamper bar 60 as interface surface 68 wears away during tamping operations.

It will be apparent to those skilled in the art that various modifications and variations can be made to the disclosed tamper bar and wear plate for a screed assembly on a paving machine without departing from the scope of the disclosure. Other embodiments of the tamper bar and wear plate will be apparent to those skilled in the art from consideration of the specification and practice of the aspects disclosed herein. It is intended that the specification and examples be considered as exemplary only, with a true scope of the disclosure being indicated by the following claims and their equivalents.

The invention claimed is:

1. A screed assembly for a paving machine, the screed assembly comprising:

a screed frame;

a screed plate attached to the screed frame;

a wear plate attached to the screed frame;

a tamper bar mounted to the screed frame and configured for up and down reciprocating motion relative to the screed frame;

a heating element mounted at least partially within a recess formed within the tamper bar, wherein at least a portion of the heating element extends through a bore formed in the tamper bar, and wherein the portion of the heating element extending through the bore formed in the tamper bar is clamped between a clamping plate extending along a top surface of the heating element and a thermally conductive insert positioned below the heating element in the bore and configured to provide a thermal conductive path between the heating element and the tamper bar; and an eccentric drive mechanism mounted on the screed frame and configured for driving the tamper bar up and down in a reciprocating manner relative to the screed frame;

a bottom portion of the tamper bar configured to slide along the wear plate, which is attached to the screed frame in between the screed frame and the reciprocating tamper bar; and the tamper bar including at least two intersecting chamfered surfaces with different angles from each other and relative to the screed plate at a leading edge of the tamper bar facing in a direction of travel of the paving machine as the paving machine is applying paving material to a surface.

2. The screed assembly according to claim 1, wherein the screed plate is attached to the screed frame by a carrier structure, and the screed assembly further includes a vibratory mechanism operatively connected to the carrier structure and configured to vibrate the carrier structure and screed plate.

3. The screed assembly according to claim 1, wherein the wear plate includes recessed fittings configured for attaching the wear plate to the screed frame, with each of the recessed fittings sitting flush with or below a surface of the wear plate facing the tamper bar so as to not protrude into a space defined between a forward-facing surface of the wear plate and an aft-facing surface of the tamper bar.

4. The screed assembly according to claim 1, wherein the portion of the heating element extends through the bore formed in the tamper bar in a direction substantially perpendicular to the direction of travel of the paving machine.

5. The screed assembly according to claim 4, wherein a plurality of hold-down bolts extend vertically through the tamper bar from a top surface of the tamper bar to the clamping plate, each of the bolts being configured to be tightened down onto the clamping plate to eliminate air gaps and enhance the thermal conductive path between the heating element and the tamper bar.

6. The screed assembly according to claim 5, wherein the heating element is a flat-surface geometry heating element, and the thermally conductive insert positioned below the heating element has a half-round cross section to enhance the thermal conductive path between the heating element and the tamper bar.

7. A paving machine, comprising:

an engine;

a hopper for receiving asphalt material;

a conveyor system for transporting the asphalt material rearward from the hopper for deposit onto a surface; and a screed assembly operatively associated with the engine and configured to smooth and compact the asphalt material into a mat, the screed assembly including:

a screed frame;

a screed plate attached to the screed frame;

a wear plate attached to the screed frame;

a tamper bar mounted to the screed frame and configured for up and down reciprocating motion relative to the screed frame;

a heating element mounted at least partially within a recess formed within the tamper bar, wherein at least a portion of the heating element extends through a bore formed in the tamper bar, and wherein the portion of the heating element extending through the bore formed in the tamper bar is clamped between a clamping plate extending along a top surface of the heating element and a thermally conductive insert positioned below the heating element in the bore and configured to provide a thermal conductive path between the heating element and the tamper bar; and an eccentric drive mechanism mounted on the screed frame and configured for driving the tamper bar up and down in a reciprocating manner relative to the screed frame;

a bottom portion of the tamper bar configured to slide along the wear plate, which is attached to the screed frame in between the screed frame and the reciprocating tamper bar; and the tamper bar including at least two intersecting chamfered surfaces with different angles from each other and relative to the screed plate at a leading edge of the tamper bar facing in a direction of travel of the paving machine as the paving machine is applying paving material to a surface.

8. The paving machine according to claim 7, wherein the screed plate is attached to the screed frame by a carrier structure, and the screed assembly further includes a vibratory mechanism operatively connected to the carrier structure and configured to vibrate the carrier structure and screed plate.

9. The paving machine according to claim 7, wherein the wear plate includes recessed fittings configured for attaching the wear plate to the screed frame, with each of the recessed fittings sitting flush with or below a surface of the wear plate facing the tamper bar so as to not protrude into a space defined between a forward-facing surface of the wear plate and an aft-facing surface of the tamper bar.

10. The paving machine according to claim 7, wherein the portion of the heating element extends through the bore formed in the tamper bar in a direction substantially perpendicular to the direction of travel of the paving machine.

11. The paving machine according to claim 10, wherein a plurality of bolts extend vertically through the tamper bar from a top surface of the tamper bar to the clamping plate, each of the bolts being configured to be tightened down onto the clamping plate to enhance the thermal conductive path between the heating element and the tamper bar.

12. A tamper bar and wear plate assembly for a screed assembly on a paving machine, the tamper bar and wear plate assembly comprising:

a tamper bar;

a heating element mounted at least partially within a bore formed within the tamper bar, wherein the heating element is a flat-surface geometry heating element clamped between a clamping plate extending along a top surface of the heating element and a thermally conductive, half-round insert positioned below the heating element in the bore and configured to provide a thermal conductive path between the heating element and the tamper bar; and a wear plate attached to a screed frame of the screed assembly on the paving machine by one or more recessed fasteners;

the tamper bar configured for sliding engagement with the wear plate along a substantially vertical interface surface of a bottom portion of the tamper bar;

the tamper bar including a bottom surface that extends in a direction substantially parallel to a direction of travel of the paving machine and substantially perpendicular to a direction of compaction of material being applied to a surface by the paving machine, the bottom surface of the tamper bar intersecting with a first chamfered surface extending upward from the bottom surface at a first angle relative to the bottom surface toward a forward-facing leading edge of the tamper bar, and the first chamfered surface intersecting with a second chamfered surface extending upward from the first chamfered surface at a second angle relative to the bottom surface to intersect with the forward-facing leading edge of the tamper bar, wherein the second angle is greater than the first angle, and a gap being formed between upper portions of the tamper bar and the wear plate above the substantially vertical interface surface, the gap being unobstructed by any portion of the one or more recessed fasteners attaching the wear plate to the screed frame.

* * * * *